US005582846A

United States Patent [19]

Cooper et al.

[11] Patent Number: 5,582,846

[45] Date of Patent: Dec. 10, 1996

[54] APPARATUS FOR FORMING COMPRESSIBLE MATERIAL INTO DISCRETE SOLID BLOCKS

[75] Inventors: Donnell Cooper; Bobby L. Starling, both of Charlotte, N.C.

[73] Assignee: Pneumafil Corporation, Charlotte, N.C.

[21] Appl. No.: 220,277

[22] Filed: Mar. 30, 1994

Related U.S. Application Data

[63] Continuation of Ser. No. 928,806, Aug. 12, 1992, Pat. No. 5,326,511.

[51] Int. Cl.[6] ..... B30B 11/02; B30B 15/22; B30B 15/30

[52] U.S. Cl. ..... 425/140; 425/147; 425/149; 425/150

[58] Field of Search ..... 425/256, 414, 425/449, 140, 145, 147, 149, 150

[56] References Cited

U.S. PATENT DOCUMENTS

| | | | |
|---|---|---|---|
| 2,151,855 | 3/1939 | Kobold | 425/330 |
| 3,563,164 | 2/1971 | Carkhuff | 100/98 R |
| 3,695,172 | 11/1972 | Cleary et al. | 100/45 |
| 4,108,063 | 8/1978 | Randolph | 100/53 |
| 4,413,967 | 11/1983 | Burry | 425/149 |
| 4,447,198 | 5/1984 | Long et al. | 425/140 |
| 4,452,579 | 6/1984 | Janson | 425/140 |
| 4,936,206 | 6/1990 | Miles et al. | 100/3 |
| 5,059,372 | 10/1991 | Klais | 264/120 |
| 5,203,261 | 4/1993 | Davis | 100/42 |

*Primary Examiner*—Robert Warden
*Assistant Examiner*—Theresa T. Snider
*Attorney, Agent, or Firm*—Shefte, Pinckney & Sawyer

[57] ABSTRACT

An apparatus for forming compressible material into discrete solid blocks or briquettes in which the material is compressed in a compression chamber by a pre-press ram and a main ram. A control system is provided which includes sensors for generating signals that are a function of the density of the compressed and densified material within the compression chamber, and an arrangement which is responsive to the sensors is provided for varying the operation of the material feeding device to change the volumetric flow of material fed to the compression chamber in response to predetermined changes in the density of the material in the chamber.

6 Claims, 6 Drawing Sheets

APPARATUS FOR FORMING COMPRESSIBLE MATERIAL INTO DISCRETE SOLID BLOCKS

CROSS-REFERENCE TO RELATED APPLICATION

The present application is a continuation of co-pending application Ser. No. 07/928,806, filed Aug. 12, 1992 issued Jul. 5, 1994 as U.S. Pat. No. 5,326,511.

BACKGROUND OF THE INVENTIONI

The present invention relates generally to an apparatus by which a compressible and cohesive material may be compressed, densified and formed into a discrete solid block for disposal or other uses.

While the present invention is applicable for use with virtually any material that is compressible and sufficiently cohesive to remain in a compressed state after being pressed into such state, it is particularly applicable in a variety of manufacturing and processing operations which generate a high volume of waste or by-products that must be handled in an environmentaty safe manner that is also efficient and cost-effective. For example, in various textile plants, a large quantity of lint and other textile waste is generated which must be disposed of, and because of its open and fluffy characteristics, it occupies a large volume and poses a particularly difficult problem in terms of temporary storage and ultimate disposal.

It is known to compress materials such as textile waste, saw dust, and the like into discrete solid blocks utilizing so-called briquetting machines like those described in Klais U.S. Pat. No. 5,059,372 and German patent No. DE 33 33 766 C2, whereby a high volume of such material is compressed into a relatively small and dense briquette that is easy to handle, transport, and dispose of or use for varying purposes (e.g. as fuel).

As described in greater detail in the above-described patents, these known machines generally include a compression chamber having a portion in which material to be compressed is fed from a hopper and a pre-press ram is used to initially compress the material after which a main ram is moved into the chamber to complete the densifying and compression of the material so that it is formed into a briquette or discrete solid block and then ejected from the machine, after which the cycle is repeated.

In these known machines, the material is fed to the compression chamber at a generally fixed flow rate by a rotatable auger which is rotated a predetermined number of revolutions during each cycle of operation. It has been found, however, that in some situations, such as for example in dealing with the textile waste materials described above, the waste may come from different parts of a textile mill or plant, and, in many instances, the individual components that make up the waste will vary in density, size and concentration levels so that at any given time during the cycles of operation of the machine it may be compressing material that has a different overall density than at other times during the operation. Since the auger is delivering the material to the compression chamber at a generally constant flow rate, the variations in the make up of the waste can, and often do, cause the machine to operate in either underload or overload conditions, and while there are subsystems within the machine that will enable it to operate despite underload or overload ("upset") conditions, these subsystems nevertheless operate at the expense of the production rate of the machine, and in some cases the machine will shut down if too many "upset" conditions occur within a given period of time.

In accordance with the present invention, the above-described drawbacks of known briquetting machines are alleviated or cured by an automatic feed compensation system that maintains a substantially consistent briquette size, and therefore maintains a substantially constant and efficient production rate for the machine.

SUMMARY OF THE INVENTION

Briefly summarized, the present invention provides an apparatus for forming a compressible and cohesive material into discrete solid block, which includes a compression chamber, apparatus for feeding such material into the chamber at a predetermined volumetric flow, and a ram arrangement mounted for movement within the compression chamber for compressing and densifying the material within the chamber. The apparatus is provided with a control system that includes a sensing arrangement for generating a signal that is a function of the density of the compressed and densified material within the chamber, and also includes a feed control responsive to the sensing apparatus for varying the operation of the material feeder to change the aforesaid volumetric flow of material fed to the chamber in response to predetermined changes in the density of the material within the chamber.

Preferably, the control system causes the material feeder to increase the volumetric flow of material to the chamber when the signal generated by the sensing arrangement indicates that the density of the material in the chamber is below a predetermined minimum level, and decreases such flow when the generated signal indicates that the density of the material in the chamber is above a predetermined maximum level. The material feeder may be a rotatable auger, and the feed control device adjusts the rotation of the auger to change the volumetric flow of material fed to the chamber.

It is also preferred that the ram include a pre-press ram operated by a fluid motor to initially compress and densify the material, and a separate main ram operated by a fluid motor to complete the compressing and densifying of the material, and the sensing arrangement includes a first sensor for sensing the pressure of the fluid in the fluid motor for the pre-press and main rams, respectively, and includes second sensors for sensing the position of the pre-press and main rams when the pressure in each such fluid motor reaches a predetermined level. The second sensors may also be arranged to generate a signal when the main ram has moved into the compression chamber past a predetermined point of reference, and, preferably, the control system operates to decrease the flow of material fed to the compression chamber when either or both of the pre-press ram and the main ram do not reach a predetermined position within the compression chamber when the pressure in the fluid motors for each of these rams has reached a predetermined pressure level, and increase the flow of material to the compression chamber when the second sensor indicates that the main ram has moved into the compression chamber past a predetermined point of reference.

Finally, the apparatus is preferably designed to operate in sequential cycles, with a solid block of compressed and densified material being formed during each cycle, and the control system is operative to change the volumetric flow of material to the compression chamber only in response to receiving signals generated by the sensors during a plurality of preceding cycles.

DESCRIPTION OF THE PREFERRED EMBODIMENT

Figure 1:
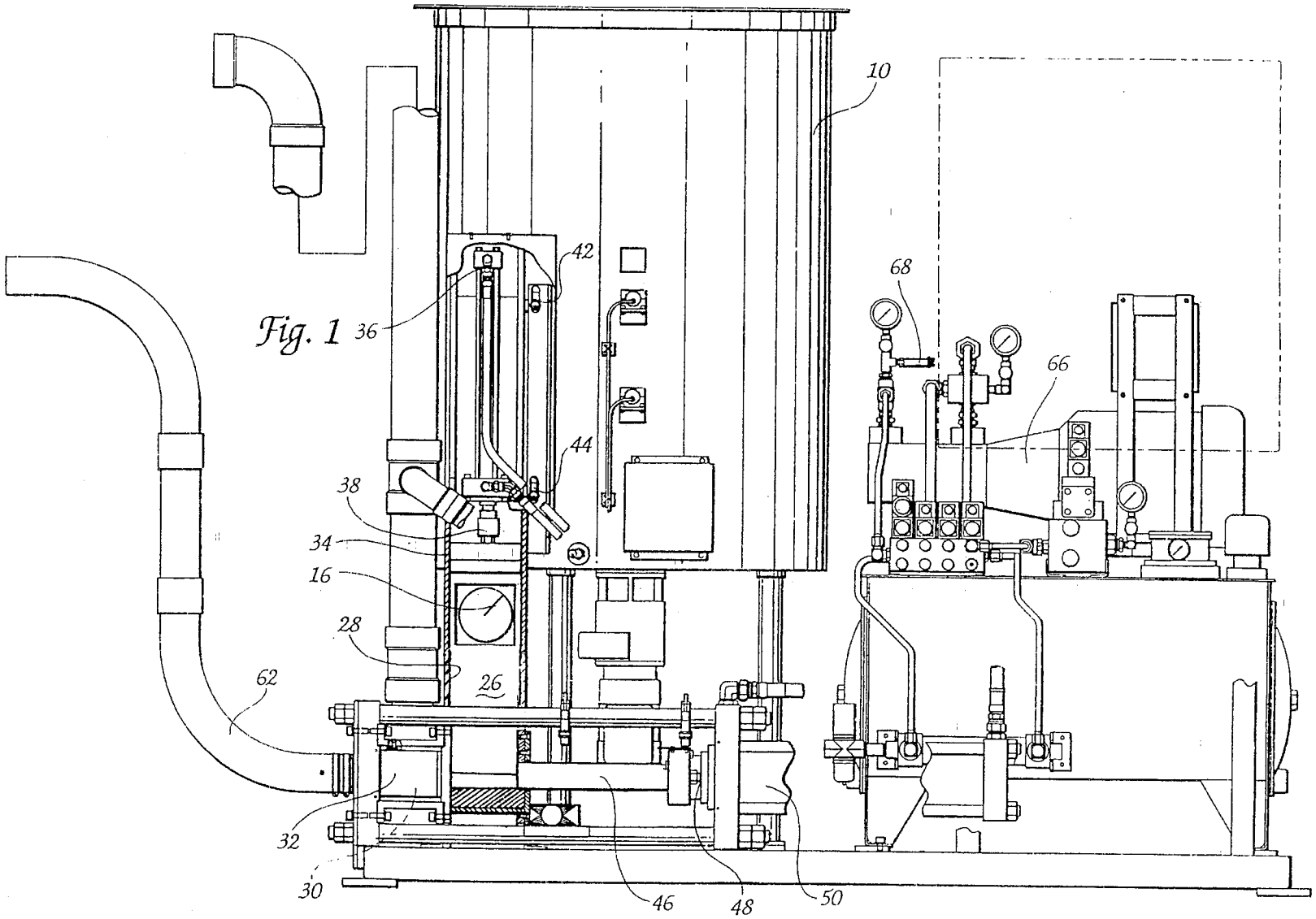
FIG. 1 is a side elevational view of one embodiment of the apparatus of the present invention, partially broken away for clarity of illustration.
Figure 2:
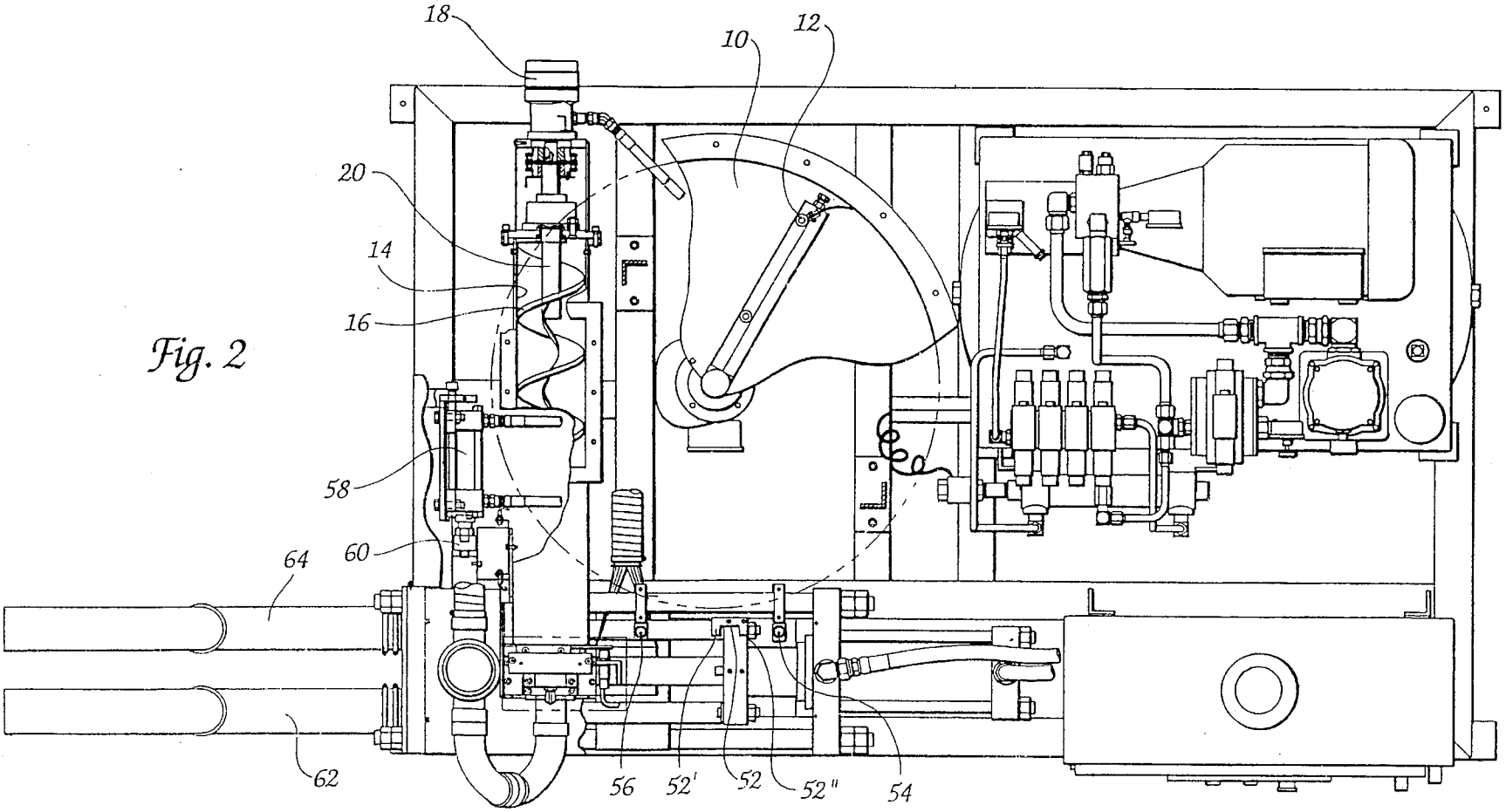
FIG. 2 is a plan view of the apparatus shown in FIG. 1, also partially broken away for clarity of illustration.
Figure 3:
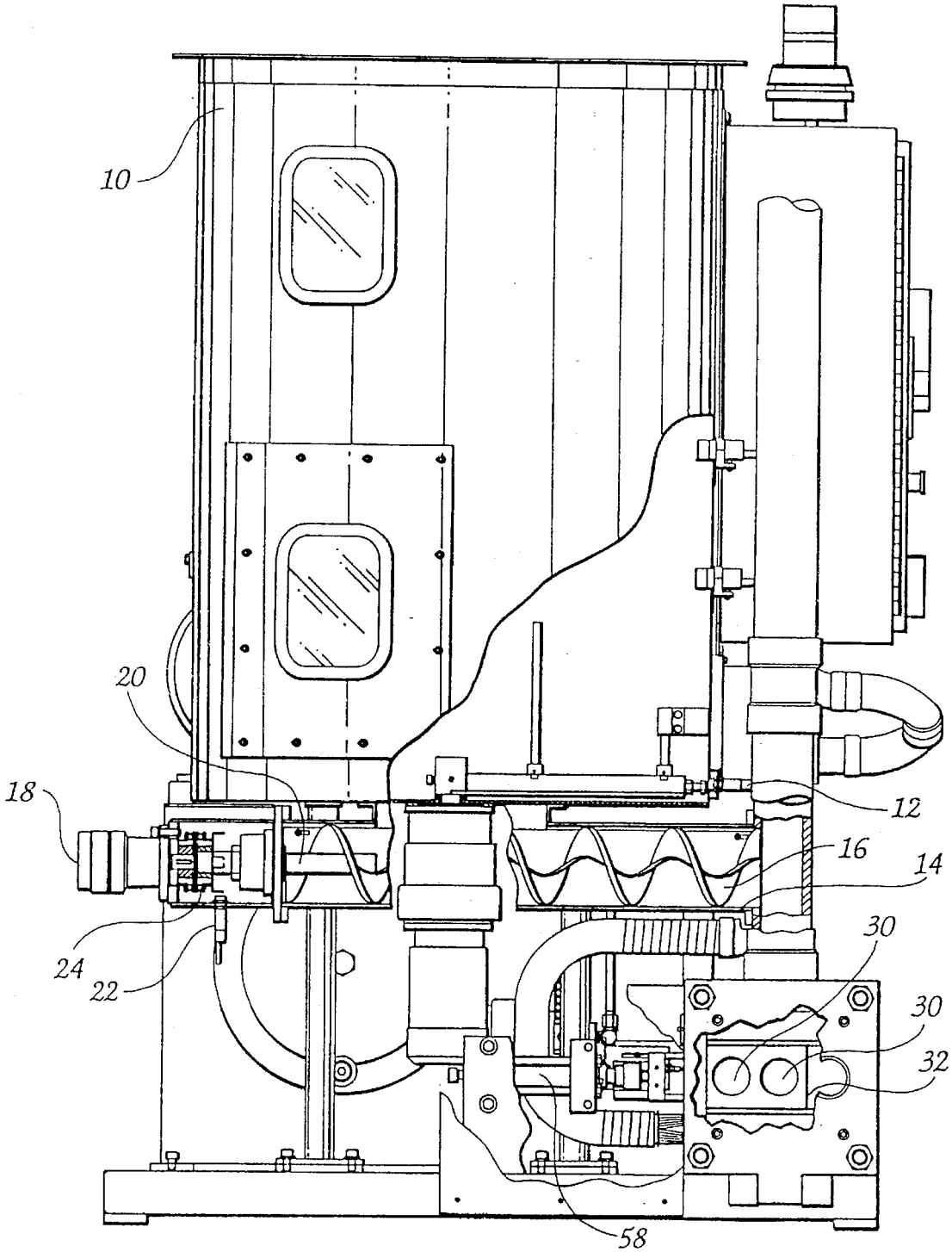
FIG. 3 is a front elevational view of the apparatus illustrated in FIG. 1, also partially broken away for clarity of illustration.

Looking now in greater detail at the accompanying drawings, FIGS. 1–3 illustrate one embodiment of the present invention in the form of an apparatus for forming textile waste material of the above-described type into briquettes or solid blocks, but it is to be expressly understood that the present invention may be used to form briquettes or solid blocks from a variety of other compressible and cohesive materials.

The apparatus illustrated in FIGS. 1–3 includes a storage hopper 10 which receives from any convenient source textile waste materials for temporary storage therein, and the storage hopper is provided with a stirrer arm 12 which rotates within the hopper 10 to maintain the textile waste material in a loose and flowable condition so that it will pass freely through an opening in the bottom of the hopper 10 into a horizontal feed chute 14 (see FIG. 3) which houses an auger 16. The auger 16 is rotated by a hydraulic motor 18 through a drive shaft 20, and the feed chute 14 has mounted therein a sensor 22 disposed adjacent a trip arm 24 mounted on the auger drive shaft 20, for rotation therewith, the trip arm 24 having four radially projecting arm portions spaced at ninety degree intervals so that one of the arm portions passes over the sensor 22 during each one quarter revolution of the drive shaft 20, all for a purpose to be described in greater detail below.

As best seen in FIG. 1, the delivery end of the auger chute 14 opens into a compression chamber 26 which includes a vertically extending pre-press portion 28 and a final compression portion 30 which is an opening located in a movable die block 32 that will be described in more detail presently.

A pre-press ram 34 is disposed within the pre-press compression chamber portion 28, and the pre- press ram 34 is moved vertically therein by a conventional fluid motor 36 that reciprocates a piston rod 38 connected to the pre- press ram 34 to move it between an upper raised position as illustrated in FIG. 1 and a lower position near to, but spaced from, the bottom wall of the vertically extending pre-press compression chamber 28. A trip strip 40 (see FIG. 4) is mounted on the piston rod 38 for movement therewith, and it extends outwardly so as to move in a path that will normally cause it to move between and beneath a first pre-press sensor 42 and a second pre-press sensor 44 which are vertically spaced from one another as best seen in FIG. 1. As will be explained in more detail presently, the trip strip 40 will normally be positioned directly beneath the upper sensor 42 when the pre-press ram 34 is in its fully raised position, and will be located beneath the lower sensor 44 when the pre-press ram is properly located at its lowermost position.

A main ram 46 is connected to the piston rod 48 of a hydraulic motor 50 which moves the main ram 46 horizontally between a first retracted position at which the front face of the main ram 46 is essentially flush with one of the sidewalls defining the pre-press portion 28 of the compression chamber 26 as illustrated in FIG. 1, and a second extended position at which the end face of the main ram 46 is adjacent the open end of the final compression portion 30 of the compression chamber 26. As best seen in FIGS. a trip strip 52 is mounted on the piston rod 48 for movement therewith, and it will be noted that the trip strip 52 has a U-shaped configuration (see FIG. 2) so as to present two projecting leg portions 52' and 52". In normal operation, and as will be described in greater detail in connection with a complete description of the operation of the apparatus, the leg portion 52" will normally be located beneath a first sensor 54 when the main ram is in its above-described retracted position, and the other leg portion 52' will normally be located beneath a second sensor 56 when the main ram 46 is at its above-described extended position.

The die block 32 which contains the final compression portion 30 of the compression chamber 26 is movable horizontally by a hydraulic fluid motor 58 acting through a piston rod 60 (see FIG. 2) to move the die block 32 in a conventional and known manner between alternating left and right-hand positions so that the final briquettes formed in the final compression portion 30 can be alternately ejected therefrom into two briquette delivery tubes 62 and 64. More specifically, the die block 32 is formed with two identical openings located side by side as illustrated in FIG. 3, and each of which alternately becomes the final compression portion 30 of the compression chamber 26 when it is located immediately adjacent the bottom portion of the pre-press compression chamber portion 28. Looking at FIG. 3, a briquette will be formed by the apparatus in the illustrated final compression portion 30 during one cycle of the apparatus, after which the die block 32 will be moved toward the right in FIG. 3 until the right-hand final compression portion 30 coincides with the delivery tube 64 whereupon the briquette formed therein is ejected into the delivery tube 64, and, at the same time, the other identical final compression portion 30 will be positioned adjacent the bottom of the pre-press compression chamber portion 28 so that another briquette is being formed therein during a subsequent cycle. Then, the die block 32 is moved toward the left and to its position as shown in FIG. 3, whereupon the second briquette is delivered to the delivery tube 62 and the right-hand final compression portion 30 is again positioned adjacent the lower portion of the pre-press compression chamber portion 28. This sequence is repeated continuously during the operation of the apparatus in a conventional manner.

All of the above-described fluid motors 18,36,50 and 58 are preferably hydraulic motors which receive hydraulic fluid from a pump/motor unit 66 through a conventional hydraulic circuit, the details of which may take a variety of forms and are not important to the understanding of the present invention, except that a pressure transducer 68 is located in the hydraulic circuit that supplies the hydraulic motors so that the pressure transducer 68 senses the pressure within the fluid motors as they are operated by the pump/motor 66, and the pressure transducer 68 generates a signal indicative of the hydraulic pressure sensed in the hydraulic motors.

Figure 4:
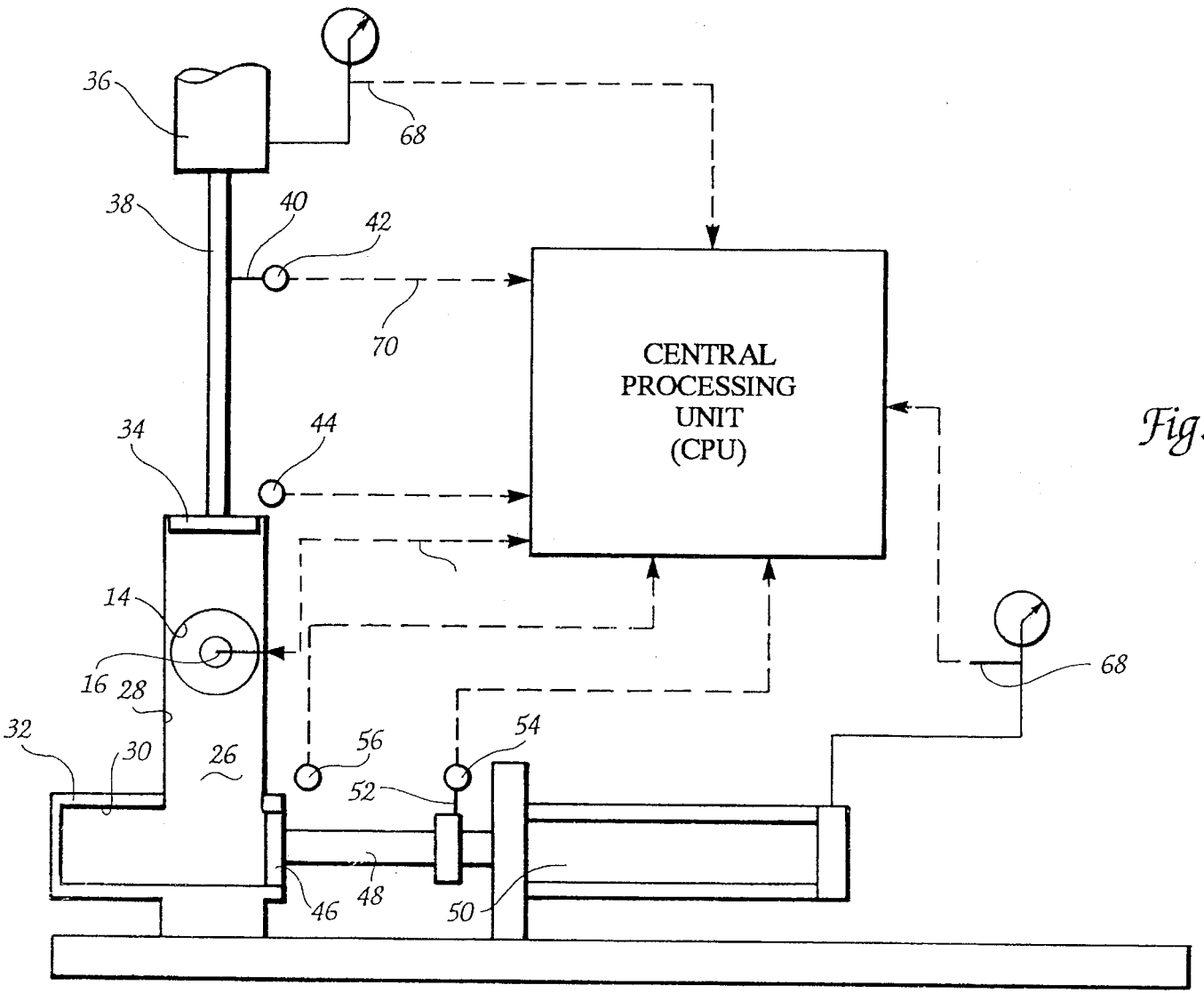
FIG. 4 is a diagrammatic view illustrating the apparatus of the present invention at its initial operating position.
Figure 5:
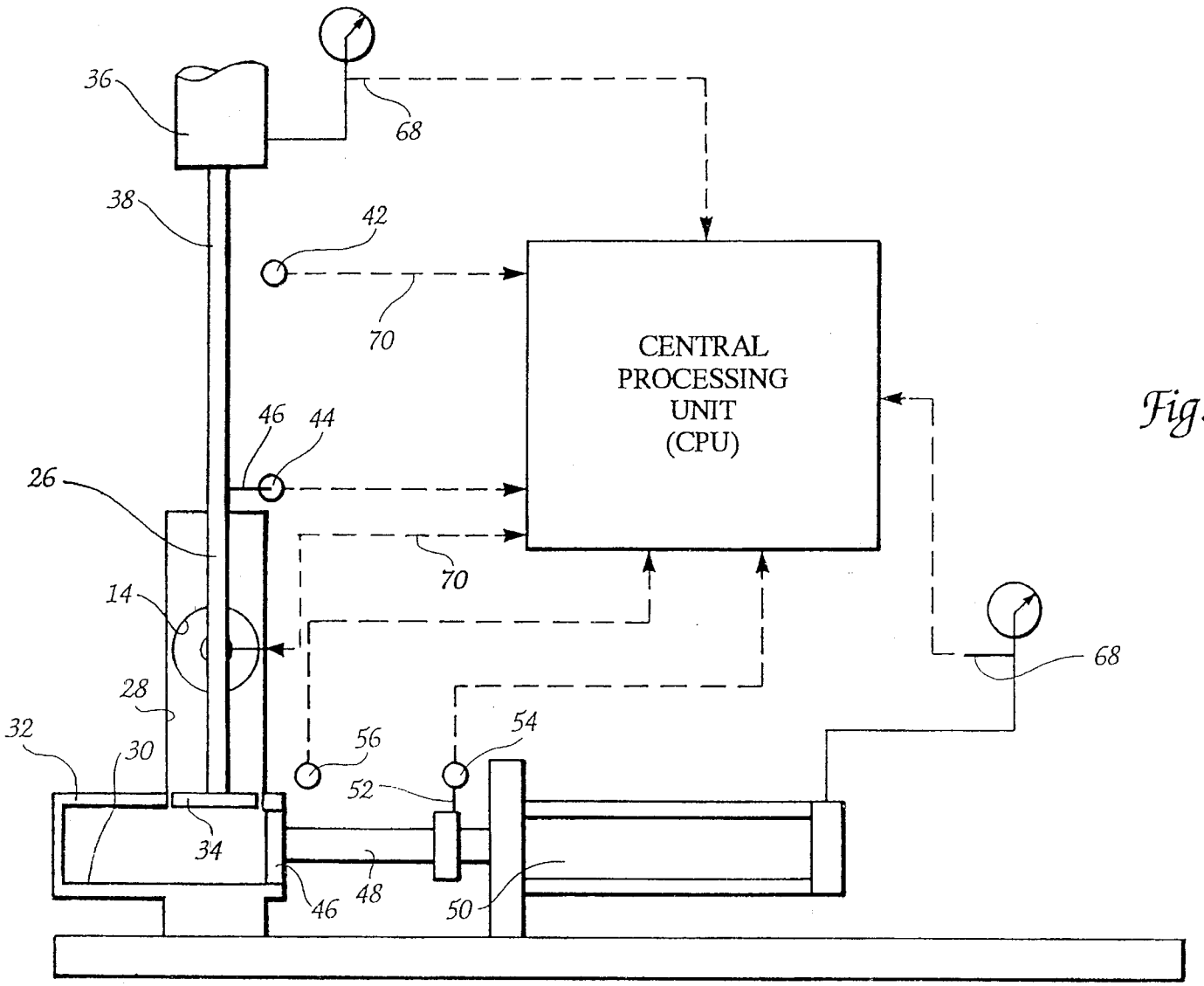
FIG. 5 is a diagrammatic view similar to FIG. 4 and illustrating the apparatus of the present invention at an intermediate operating position.
Figure 6:
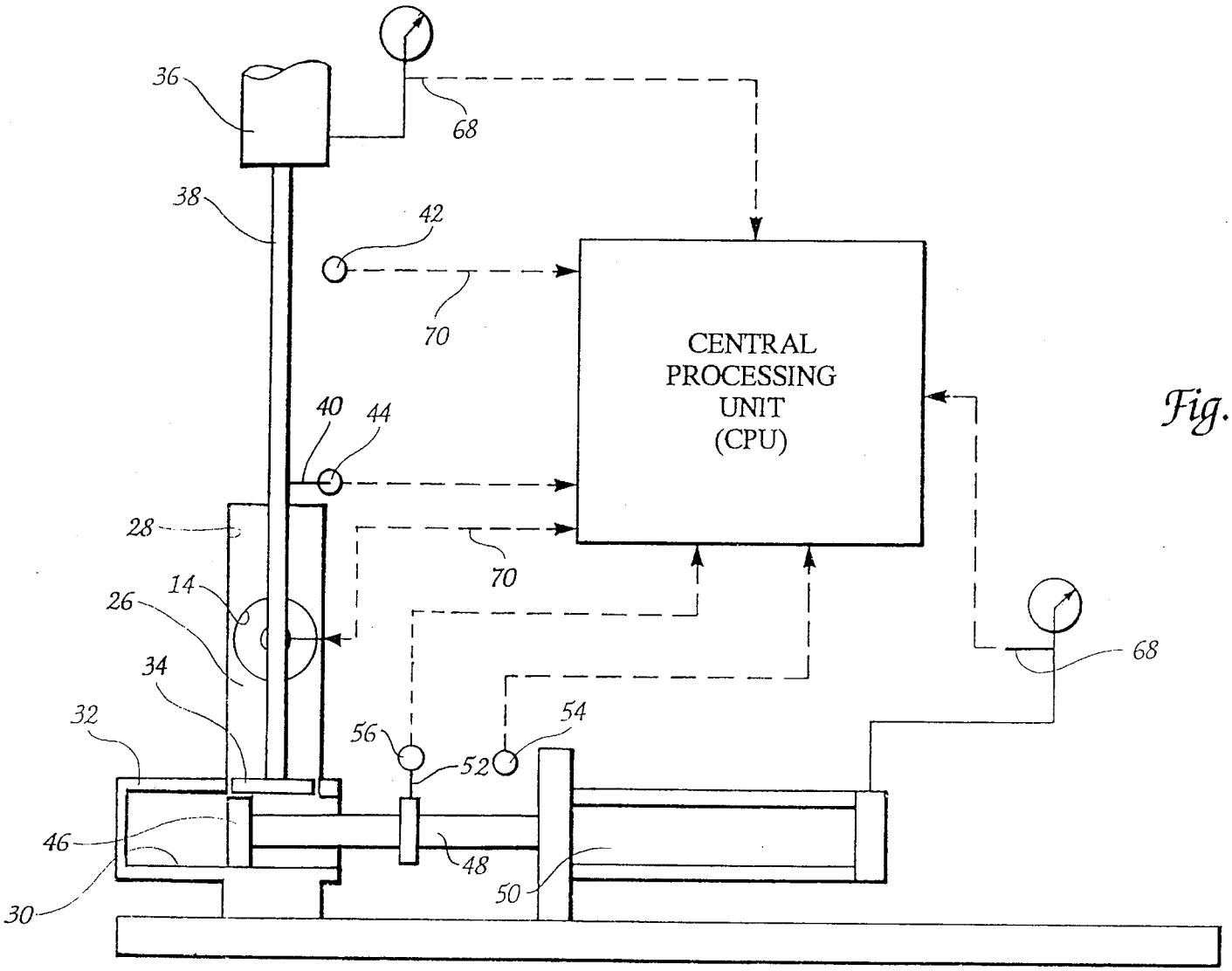
FIG. 6 is a further diagrammatic view illustrating the apparatus of the present invention at its final operating position.

FIGS. 4–6 provide diagrammatic or schematic illustrations showing the normal sequence of operation of the apparatus of the present invention. It will be noted that in each of these Figures, a central processing unit (CPU) is indicated diagrammatically, and it is a conventional computer that is programmed to operate the various aspects of the apparatus through conventional electronic circuits designated as 70 in FIGS. 4–6, including the particular steps of operation to be described below. Any suitable computer can be used, and it can be programmed using conventional programming techniques that are well-known in the art. All of the above-described sensors 22,42,44,54 and 56 are preferably proximity sensors, such as the inductive proximity sensors manufactured by Omron Company as Model No. TL-XD5 which will generate a signal when the magnetic field thereof is interrupted by the presence of the trip arm or trip strip moving into such magnetic field.

Looking first at FIG. 4, the system of the present invention is diagrammatically illustrated in its normal condition at the beginning of an operating cycle. The pre-press ram 34 is positioned at its upper or raised position in the pre-press compression chamber portion 28, and the main ram 46 is disposed at its retracted position. Depending on the type of material that is being processed by the system, and particularly the density of such material, the CPU is set to cause the motor 18 for the auger 16 to make a predetermined number of revolutions during each cycle of the apparatus, thereby delivering a predetermined volumetric flow of material to the compression chamber 26 from the auger chute 14. After the auger 16 has been rotated in this manner, the compression chamber 26 will be filled with material in an uncompressed condition. The CPU then initiates the next step in the cycle, namely to connect the pump/motor 66 to the hydraulic motor 36 for the pre-press ram 34, whereupon the hydraulic pressure in the hydraulic motor 36 causes the pre-press ram 34 to move downwardly and initially compress the material in the compression chamber 26. The CPU is programmed to cause the pump/motor 66 to continue supplying hydraulic fluid to the motor 36 until the pressure in the hydraulic circuit supplying the motor 36 reaches a predetermined level, which is set in the CPU for the particular material being processed (e.g., approximately 2,000 psi for textile waste), at which point a solenoid operated valve or other conventional control (not shown) in the hydraulic circuit will stop the further flow of hydraulic fluid to the motor 36, and the movement of the pre-press ram 34 will stop. The system is designed so that during normal operation, the pre-press ram 34 will stop when it reaches its lowermost position in the pre-press compression chamber portion 28 adjacent to the top edge of the main ram 46, as shown in FIG. 5, because, at this position, the trip strip 40 will have moved into the magnetic field of the lower sensor 44, as also shown in FIG. 5. After the pre-press ram 34 has stopped at its lowermost position, the pressure of the hydraulic fluid in the hydraulic motor 36 will rise to its predetermined level to stop the further flow of hydraulic fluid to the motor 36.

In the preferred embodiment of the present invention, the final compression chamber portion 30, which is formed in the die block 32, is cylindrically shaped as illustrated in FIG. 3, and the main ram 46 also has a corresponding cylindrical shape so that it can, in some instances, extend into the final compression chamber portion 30 as will be described in more detail below. Also, the lower face of the pre-press ram 34 is formed with a semi- circular convexity, and the bottom surface of the pre-press compression chamber portion 28 is similarly formed with an upwardly facing semi-circular convexity so that when the pre-press ram 34 is at its lowermost position, its lower face and the upwardly facing bottom wall of the pre-press compression chamber portion 28 will form a cylindrical cavity through which the cylindrically-shaped main ram 46 can pass in finally compressing the material in the compression chamber 26.

After the pre-press ram 34 has stopped, the CPU initiates the next step in the cycle which is illustrated in FIG. 6. Hydraulic fluid from the pump/motor 66 is supplied to the motor 50 so that it moves the main ram 46 from its retracted position (FIG. 5) to its extended position (FIG. 6) at which the end face of the main ram 46 is substantially flush with the inner face of the die block 32 so that all of the material originally contained in the compression chamber has now been compressed and densified and formed into a solid block or briquette within the opening 30 in the die block. Also, as was the case with the pre- press ram 34, the CPU is programmed to stop further movement of the main ram 46 when the signal generated by the pressure transducer 66 indicates that the pressure in the hydraulic motor 50 has reached a predetermined level, and in normal operation this will occur when the main ram 46 is at its aforesaid properly extended position and with the leading leg 52' (see FIG. 2) of the trip strip 52 positioned to interrupt the magnetic field of the left-hand sensor 56 as illustrated in FIG. 6. The main ram 46 is then retracted by the CPU until it has reached its fully retracted position at which the leg 52" of the trip strip 52 is positioned to interrupt the magnetic field of the right-hand sensor 54 which stops further retracting movement of the main ram 46. The die block 32 is then moved in one direction or the other by its fluid motor 58 in the manner described above, and the other opening 30 in the die block 32 is positioned adjacent the pre-press compression chamber portion 28, and the pre-press ram 34 is then returned by its motor 36 to its initial positions as illustrated in FIG. 4 in preparation for the initiation of a new cycle, at which point further movement of the pre-press ram 34 is stopped by the trip strip 40 interrupting the magnetic field of the sensor 42. The apparatus will continuously operate in the manner described above for a sequence of cycles as long as the quantity of the material within the compression chamber 26 is within desired parameters and the various components of the apparatus are operating normally in the manner described above.

However, as discussed above, variations in the make-up of the materials to be compressed, and particularly the density characteristics thereof, will often result in significant variations of the density of the material within the compression chamber 26 that can adversely affect the production rate and efficiency of the apparatus. Accordingly, in accordance with the present invention, the apparatus is designed to compensate for such variations, and adjust the operation of the apparatus to correct such variations.

More specifically, and looking again at FIG. 4, it will be apparent that if the density of material fed to the compression chamber 26 by the auger 16 is greater than normal by a predetermined amount, when the pre-press ram 34 is moved downwardly to partially compress such material, the density of the material in its path will gradually increase and create resistance to its downward movement. Since, as indicated above, the CPU is programmed to stop the delivery of pressurized hydraulic fluid to the hydraulic motor 36 when the pressure therein, as sensed by the pressure transducer 68, reaches a predetermined level, if too much material has been fed to the compression chamber 26, movement of the pre-press ram 34 will stop prior to its reaching its normal and desired position which is illustrated in FIG. 5, and the trip strip 40 will not reach the lower sensor 44 and no signal will be sent by that sensor back to the CPU. The CPU is programmed so that when, during any cycle, the signal generated by the pressure transducer 68 indicates that the hydraulic pressure in the fluid motor 36 has reached its predetermined level and there is no signal generated by the lower sensor 44, the CPU registers a "high density fault".

In some cases, even where the density of the material in the compression chamber is above the desired level, the pre-press ram 34 will operate normally, but after the pre-press ram 34 has stopped at its desired position, the movement of the main ram 46 will be stopped short of its desired position flush with the die block 32 because the density of the material being compressed by the main ram 46 will cause the pressure within the hydraulic motor 50 to reach its predetermined level before the main ram 46 reaches its fully extended position, and, again, it will be noted that the leading leg 52' of the U-shaped trip strip 52 will not have reached the left sensor 56 so that no signal is generated by the sensor 56 and transmitted to the CPU. When the signal generated by the pressure transducer 68 is transmitted to the CPU indicating that the pressure level in the fluid motor 58 has reached its desired predetermined level, and no signal is received from the second sensor 56, the CPU will also register a "high density fault".

On the other hand, if during any given cycle, the material fed to the compression chamber 26 by the auger 16 is less than the desired amount, the following sequence will occur. The pre-press ram 34 will be lowered to its normal lower position (as illustrated in FIG. 5), and even the decreased density of the material in the compression chamber 26 will not result in the pre- press ram 34 moving beyond and beneath its normal position, at which it would be located in the path of the subsequent movement of the main ram 46, because the pre-press ram 34 is mechanically prohibited from moving to a position beneath its normal lower position, and/or the CPU is programmed to prevent such movement by cutting off the flow of hydraulic fluid to motor 36. After the pre-press ram 34 has stopped at its lowermost position, the main ram 46 is moved towards its extended position in the manner described above. Because of the decreased density of the material in the compression chamber, the main ram 46 will move beyond its normal position flush with the end face of the die block 32 and will move into the opening 30 in the die block 32 until both the leading leg 52' and the trailing leg 52" of the trip strip 52 have interrupted the magnetic field of the left sensor 56, which generates a signal that is transmitted to the CPU and further movement of the main ram 46 is stopped, and the main ram 46 is moved oppositely until it is withdrawn from the confines of the opening 30 in the die block 32. Whenever the sensor 56 transmits two signals to the CPU indicating that both the leading and trailing legs 52', 52" of the trip strip 52 have interrupted its magnetic field, the CPU registers a "low density fault".

Thus, the combination of signals from the pressure transducer and the various sensors described above is a function of the density of the material being compressed within the compression chamber 26, and, as described above, whenever the density of such material is sensed to be at a predetermined level less than the desired density, a "low density fault" is generated, and when the sensed density of the material in the compression chamber 26 is at a predetermined level higher than the desired density level, a "high density fault" is generated. The CPU is programmed to correct or adjust the feed of material to the compression chamber 26 based on the faults which are transmitted to the CPU. More specifically, when "high density faults" are transmitted back to the CPU, it will control the operation of the fluid motor 18 for the auger 16 to decrease the rotation of the auger 16 during a subsequent cycle of operation so that less material will be fed to the compression chamber 26. As indicated above, the auger sensor 22 is preferably designed to generate a signal during each quarter revolution of the drive shaft 20 for the auger 16, and these signals are transmitted to the CPU which is operative to stop the further flow of hydraulic fluid from the pump/motor 66 to the auger motor 18 when the auger motor has made its required number of revolutions determined by the CPU. By adjusting the rotation of the auger in one-quarter revolution increments, the flow of material to the compression chamber 26 can be carefully controlled, but it is to be understood that other increments of adjustment could be used, depending on the nature of the material being compressed.

Similarly, when "low density faults" are transmitted to the CPU, it operates in the same manner as that described above, except that it increases the rotation of the auger 16 by its motor 18 in one-quarter revolution increments to thereby increase the flow of material to the compression chamber 26 for a subsequent cycle of operation.

While it is possible to program the CPU to correct the flow of material fed to the compression chamber 26 each time either a "low density fault" or a "high density fault" is received, this may, depending on the nature of the material being compressed, result in over compensation based on what might be only a minor and temporary variation in the density of the material in the compression chamber 26. Accordingly, in most instances, it will be predetermined number (e.g., 4) of consecutive "high density faults" or "low density faults". The CPU can also be programmed so that if it receives a number of faults less than the aforesaid predetermined number, and thereafter completes a certain number of subsequent cycles (e.g., 4) without receiving any additional faults, the several previously received faults will be disregarded and the CPU will not make any compensation until a new group of faults reaches the predetermined number to begin compensation.

By virtue of the continuous and careful adjustment of the material fed to the compression chamber based on generated signals which are a function of the density of the material within the compression chamber, the present invention operates to maintain consistent briquette size which significantly improves the production rate of the apparatus in terms of pounds of waste materials per hour which are converted into briquettes.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In an apparatus for forming compressible and cohesive material into discrete, solid briquettes having a predetermined volume, said apparatus including a compression chamber, material feeding means for feeding said material to said chamber at a predetermined volumetric flow, and ram means mounted for movement within said chamber for compressing said material within said chamber, the improvement comprising control means cooperating with said ram means for controlling the operation of said material feeding means responsive to signals received from said ram means, said ram means including a pre-press ram and a main ram, said pre-press ram including means for generating a pre-press ram position signal when said pre-press ram has reached a fully extended position, said pre-press ram position signal being communicated to said control means, and said main ram including means for generating a first main ram position signal and a second main ram position signal, said first and second main ram position signals being communicated to said control means, said control means controls said material feeding means to reduce the flow of material responsive to the absence of said pre-press ram position signal, to increase the flow of material responsive to the presence of both said first and second main ram position signals, and to decrease the flow of material responsive to the absence of both said first and second main ram position signals, thereby controlling the density of the resulting compressed briquette.

2. Apparatus as defined in claim 1 wherein said material feeding means is a rotatable auger, and said control means adjusts the rotation of said auger to change the volumetric flow of said material fed to said chamber.

3. Apparatus as defined in claim 1 wherein said ram means includes a fluid motor for moving said main ram and said prepress ram into said chamber and sensing means for sensing the pressure of the fluid in said fluid motor.

4. Apparatus as defined in claim 1 wherein said pre-press ram is operated by a fluid motor to initially compress and densify said material, and said main ram is operated by a fluid motor to complete the compressing and densifying of said material, and said apparatus further including sensing means for sensing the pressure of the fluid in said fluid motors for said pre-press and main rams, and said control means controls said material feeding means when the pressure in each said fluid motor reaches a predetermined level as determined by said sensing means.

5. Apparatus as defined in claim 1 wherein said apparatus operates in a sequence of cycles with a solid block being formed during each cycle of operation, and wherein said control means operates in response to a change of material density as determined by by said sensing means and said ram position siqnals during one cycle to change the volumetric flow of said material to said compression chamber during a subsequent cycle.

6. Apparatus defined in claim 5 wherein said control means operate to change the volumetric flow of said material to said compression chamber only after said change of material density has been determined during a predetermined plurality of preceding cycles.

* * * * *

UNITED STATES PATENT AND TRADEMARK OFFICE
CERTIFICATE OF CORRECTION

PATENT NO. : 5,582,846

DATED : Dec. 10, 1996

INVENTOR(S) : Donnell Cooper and Bobby L. Starling

It is certified that error appears in the above-identified patent and that said Letters Patent is hereby corrected as shown below:

Col. 1, l. 12, reads "BACKGROUND OF THE INVENTIONI" but should read -- BACKGROUND OF THE INVENTION --.

Col. 1, l. 23, reads "environmentaty" but should read -- environmentally --.

Col. 4, l. 18, reads "FIGS." but should read -- FIG. 2, --.

Col. 8, l. 35, after "be" insert -- preferable to program the CPU so that it will not make any adjustment in the rotation of the auger 16 until it has received a --.

Col. 10, l. 13, delete "and".

Col. 10, l. 28, reads "operate" but should read -- operates --.

Signed and Sealed this

First Day of July, 1997

Bruce Lehman

*Attest:*

BRUCE LEHMAN

*Attesting Officer*

*Commissioner of Patents and Trademarks*